US005808640A

United States Patent [19]

Bhaskar et al.

[11] Patent Number: 5,808,640

[45] Date of Patent: Sep. 15, 1998

[54] SPECIAL GEOMETRY INK JET RESISTOR FOR HIGH DPI/HIGH FREQUENCY STRUCTURES

[75] Inventors: Eldurkar V. Bhaskar; Peter M. Burke; Ulrich E. Hess; Zen Kurokawa; William R. Knight, all of Corvallis, Oreg.

[73] Assignee: Hewlett-Packard Company, Palo Alto, Calif.

[21] Appl. No.: 627,741

[22] Filed: Apr. 2, 1996

Related U.S. Application Data

[63] Continuation of Ser. No. 229,485, Apr. 19, 1994, abandoned.

[51] Int. Cl.[6] ..... B41J 2/05

[52] U.S. Cl. ..... 347/58; 347/62

[58] Field of Search ..... 347/58, 59, 62, 347/61, 206, 208, 65

[56] References Cited

U.S. PATENT DOCUMENTS

| | | | |
|---|---|---|---|
| 4,339,762 | 7/1982 | Shirato | 347/62 |
| 4,887,098 | 12/1989 | Hawkins | 347/58 |
| 5,157,418 | 10/1992 | Tamura | 347/58 |
| 5,198,834 | 3/1993 | Childers | 347/65 |
| 5,274,400 | 12/1993 | Johnson | 347/43 X |
| 5,387,314 | 2/1995 | Baughman | 347/65 X |
| 5,477,243 | 12/1995 | Tamura | 347/58 X |

*Primary Examiner*—Joseph W. Hartary

[57] ABSTRACT

An inkjet printhead structure comprises novel resistor circuitry that is fabricated on two different substrate layers. The dual layer circuitry reduces the required substrate surface area and printhead shelf length to increase the printer operating frequency and print density. In one embodiment of the invention, heating resistors are spread out over portions of the substrate surface area and conductors are attached to opposite ends of the heater resistors in a novel configuration. To simplify routing, the circuitry is configured so that multiple heater resistors are coupled to the same conductor return path located on a second conductive layer. In a second embodiment of the invention, the heater resistors are dimensioned in the shape of a trapezoid to provide uniform heating. Alternative resistor shapes are then introduced to provide consistent heat dissipation for variances in resistor/conductor sheet resistance.

10 Claims, 3 Drawing Sheets

SPECIAL GEOMETRY INK JET RESISTOR FOR HIGH DPI/HIGH FREQUENCY STRUCTURES

This is a continuation of application Ser. No. 08/229,485 filed on Apr. 19, 1994, now abandoned.

This invention relates generally to thin film printheads for use in thermal ink jet pens and more particularly to an improved resistor circuitry and geometry for reducing shelf length in such printheads. The term "printhead" as used herein refers to the composite layered structure consisting of a thin film resistor substrate and an insulating barrier layer and orifice plate deposited in succession thereon and adhered for bonding to an ink containment housing of a thermal ink jet pen. These pens are usually disposable and are available in black ink or color.

In the field of thermal ink jet printing, the art of constructing a thin film resistor substrate with heater resistors thereon and bonding the substrate to overlying orifice plates is well developed. The orifice plates are provided with orifice openings therein which are aligned with respect to the heater resistors on the thin film substrate. A polymer material such as Vacrel is used as an interface barrier layer between the orifice plate and the thin film substrate. This barrier layer is configured using known photolithographic masking and etching techniques for defining a firing chamber surrounding each heater resistor, and also for defining an adjacent ink feed channel and possibly an interconnecting input ink feed slot for flowing ink into the firing chambers adjacent to the heater resistors.

Typically, it has been customary to provide a single common ink feed slot which is formed in a centralized location within the thin film resistor substrate that fluidically connects this slot through a plurality of narrow ink flow paths and channel regions to printhead firing chambers. Each printhead firing chamber is located between a heater resistor and an associated orifice opening in an adjacent orifice plate. The firing chamber is typically separated from the common ink feed slot by an interconnecting channel adjacent thereto. Ink flowing from the slot to the firing chamber will flow first through the narrow ink flow path between the orifice plate and the surface of the thin film resistor substrate and then through the channel region into the firing chamber. This narrow path between the orifice plate and the thin film resistor substrate is referred to as the "shelf" area, since the surface of the thin film resistor substrate serves as a "shelf" over which the incoming ink must pass before entering the channel region and then passing into the firing chamber of the device.

It has been discovered that the utilization of the above "shelf" region between the thin film substrate and the orifice plate imposes a limitation on the maximum achievable operating frequency, $F_{max}$, for the thermal ink jet printhead. Large shelf length also limits miniaturization of the printhead die size, which prevents potentially increased fabrication yields. Reducing the "shelf" region, however, is limited by the circuitry fabricated upon the resistive substrate. For example, present resistor/conductor layouts utilize square resistors with conductor returns interdigitated with the resistors. A common conductor is then attached to the opposite end of each resistor providing connection to an external power supply.

The common conductor must be of sufficient width to minimize resistance and to effectively carry current to the heating resistors. Therefore, to effectively use the surface area of the substrate, the common is usually placed in the shelf region. In addition, the multiple conductors and square resistors of present circuit layouts restrict ultimate printing density (i.e., dots per inch (dpi)) and print quality. Accordingly, a need remains for a resistor circuit configuration for an ink jet printhead that minimizes the shelf length and allows for increased printing density while maintaining a high print quality.

SUMMARY OF THE INVENTION

The present invention is embodied in a thermal inkjet printhead having a row of heating resistors, is fabricated on a substrate adjacent to a central ink feed slot, each resistor coupled to supply and return conductors on opposite sides. The supply and return conductors extend toward a lateral edge of the printhead die and away from the central ink slot. Adjacent resistor heaters may be coupled to a single return conductor. A passivation layer is formed over the first and second conductors, and a common conductor is deposited atop the passivation layer. The common conductor is coupled to the supply conductor of each heating resistor through openings in the passivation layer. The common conductor is positioned between the row of heating resistors and the lateral edge of the printhead die, reducing the shelf length and increasing the printer operating frequency.

In one embodiment of the invention, the heating resistors are trapezoidal to normalize the temperature across the resistor heater. However, the dimensions of each heating resistor can be changed to provide consistent heat dissipation for variances in either the resistor or conductor sheet resistance. For example, as the miniaturization of printheads increase, current pinch points occur at the conductor/heater resistor interface. The pinch points decrease the amount of current in the heating resistor, and proportionally the amount of time required to sufficiently vaporize ink in the firing chamber. The trapezoidal resistor configuration minimizes current pinch points in highly miniaturized printheads.

Smaller printhead geometries also increase the resistance of the circuit conductors. The increased resistance causes the conductors to dissipate more heat and alter the conductor/heater resistor impedance ratio. This creates multiple undesirable hot spots near the heater resistor during the ink vaporization process which degrades print quality. The trapezoidal heater resistor configuration provides an increased conductor surface area which maintains a low conductor resistance with small printhead geometries. Thus, the occurrence of heater resistor hot or cool spots are minimized.

Alternatively, the ratio of resistances between the conductor surface and the resistor surface, were found to significantly alter the heat distribution characteristics of the resistor area. Thus, the ratio between the resistor and conductor sheet resistances were changed to provide consistent heat dissipation for given dimensions of the heater resistor.

The foregoing and other objects, features and advantages of the invention will become more readily apparent from the following detailed description of a preferred embodiment of the invention which proceeds with reference to the accompanying drawings.

DETAILED DESCRIPTION

Figure 1:
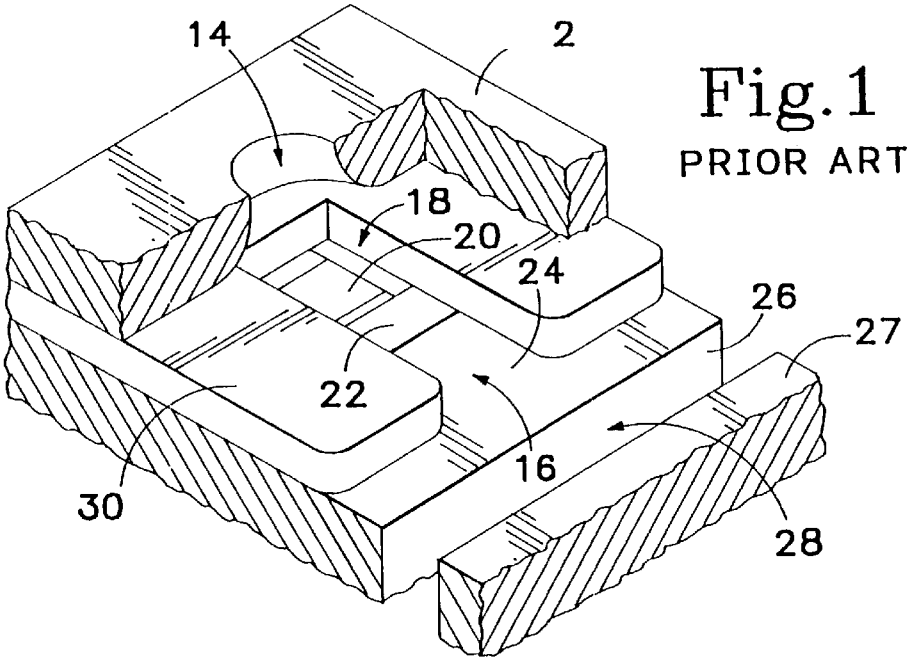
Fig. 1 PRIOR ART
FIG. 1 is a top perspective view of a prior art resistor and ink feed channel configuration.

FIG. 1 is a partial cut-away perspective view of a single firing chamber 18 in a prior art thermal ink jet printhead. A heater resistor 20 is fabricated on the surface 27 of substrate 26. An interface barrier 30 of a polymer material such as Vacrel is disposed on the substrate and defines the sidewalls of the firing chamber 18. An ink feed channel 16 connects firing chamber 18 to ink slot 28. The portion of the substrate surface between resistor 20 and ink feed slot 28 comprises a shelf 24. A common conductor 22 coupling a power supply (not shown) to resistor 20 is disposed on shelf 24. An orifice plate 12, including orifice opening 14, forms the upper wall of firing chamber 18.

Figure 2:
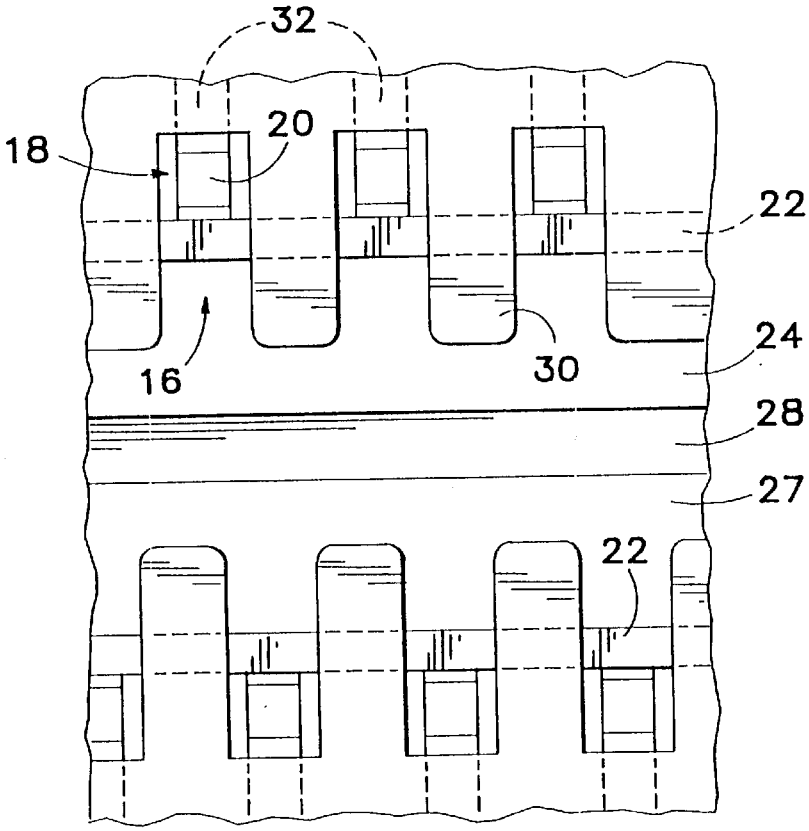
Fig. 2 PRIOR ART
FIG. 2 is a top plan view of a prior art resistor and ink feed channel array configuration.

In a typical printhead, an array of firing chambers as just described are formed on a printhead as shown in FIG. 2. Each resistor 20 is coupled at one side to a return conductor 32, and at the opposite side to common conductor 22.

In operation, each firing chamber is charged with ink from ink feed slot 28 through its respective ink feed channel 16. Each firing chamber is fired by an electrical impulse carried over common conductor 22 to the heating resistors 20, which heats, vaporizes, and ejects a portion of the ink from the cell through orifice 14 onto an adjacent print medium (not shown), completing one firing cycle. The firing chamber 18 is then refilled with a fresh charge of ink flowing from ink slot 28 through channel 16.

The time required to recharge the firing chambers 18 limits the maximum operating frequency ($F_{max}$) of an ink jet pen, as described in detail in U.S. patent application Ser. No. 07/686,079 filed Apr. 16, 1991 (now abandoned).

The rate of refilling of the firing chamber is in turn limited by the hydraulic resistance of the ink flow path between ink slot 28 and the firing chamber. The total hydraulic resistance of the ink flow path is determined primarily by the shelf resistance ($R_s$), which is proportional to the width of shelf 24. Prior efforts at increasing $F_{max}$ have included reducing the length of channel 16, and positioning ink feed slot 28 as close as possible to the inlet of ink feed channel 16 to minimize the distance between the ink feed slot and the firing chamber.

The minimum shelf length has been limited, however, by the location of common conductor 22 on shelf 24 which must be dimensioned to provide sufficient current carrying capacity and appropriate sheet resistance characteristics. For example, as conductor 22 becomes narrow, its resistance also increases. This increases the amount of power and time required to sufficiently heat resistor 20, resulting in a slower operating frequency. Alternatively, the limited routing area on the substrate surface prevents a separate conductor feed to be used for each heating resistor. For example, separate feed and return conductors would limit the print density (dpi) of the ink jet printhead.

The thin film resistor substrate 26 has an active surface passivation with one or more inorganic dielectric layers such as $SiO_2$, $Si_3N_4$, and SiC. These layers are photolithographically processed and evaporated with aluminum to provide conductive traces (i.e., conductors 22 and 32 in FIG. 2) to the heater resistors (i.e., heater resistor 20 in FIG. 2). These conductive traces serve to provide electrical drive pulses to the heater resistors, and the dielectric layers provide surface passivation and protection for the surface of the thin film resistance substrate.

Figure 3:
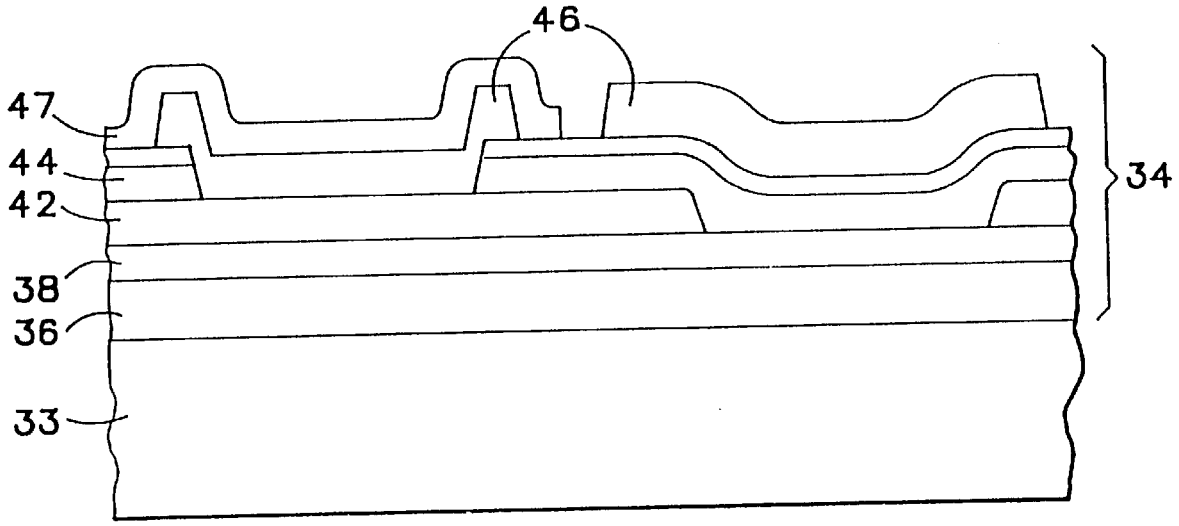
Fig. 3 PRIOR ART
FIG. 3 is a cross section of the process layers on the thin film substrate used for creating the resistor circuitry shown in FIG. 2.

A prior art thin film resistor substrate surface composite layer is shown in detail in FIG. 3. Thin film deposition processes are well known and are therefore not described in detail. One method for fabricating multi-level conductors on a thin film substrate is described in U.S. Pat. No. 4,719,477 to Hess and is hereby incorporated by reference. The specific compositions used for passivation, isolation, resistive, and conductive regions described below in FIG. 3 are given only to illustrate a typical double level metal circuit. Alternate thin film process techniques are similarly adaptable to the invention described below.

Referring to FIG. 3, a composite layer 34 resides on a silicon substrate 33 and includes a first silicon dioxide passivation layer 36, a second tantalum aluminum (Ta/Al) resistive layer 38, and a third aluminum (Al) layer 42. The Al layer 42 defines the length dimensions of the heater resistor which resides in Ta/Al layer 38. Above layer 42 is an inorganic passivation and surface protection insulation layer 44, such as a composite layer of silicon nitride and silicon carbide. The surface protection material 44 protects both the conductive trace material in layer 42 and the Ta/Al resistive layer 38 and comes in contact with the polymer barrier layer 30 (see FIG. 1). Finally, an outer tantalum gold (Ta/Au) protective metal layer 46 and a gold layer 47 reside on top of the silicon carbide layer.

Figure 4:
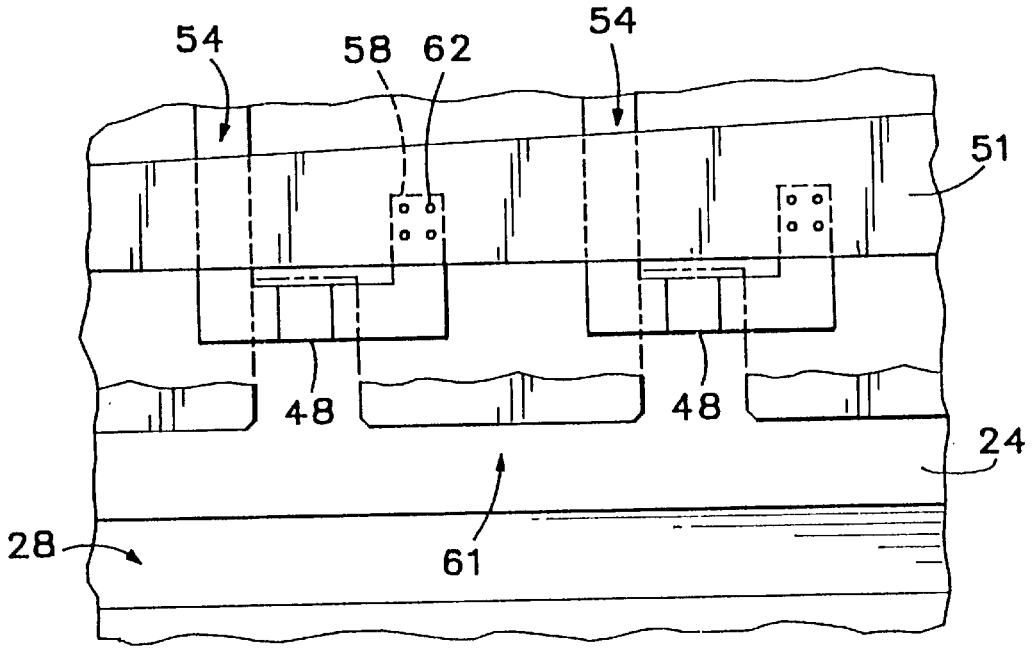
FIG. 4 is a top plan view of a resistor and ink feed channel according to a first embodiment of the invention.

FIG. 4 is a top plan view showing an array of heating resistors and their associated channels according to a first embodiment of the invention. Each heating resistor/firing chamber in the printhead is arranged in a similar manner as described hereinafter. A first conductor trace 54 is elongated in a direction perpendicular with the longitudinal direction of the ink feed slot 28 and is coupled to a first end of a heating resistor 48. A second conductor trace 58 is directed parallel with arm 54 and coupled to a second end of resistor 48. Conductors 54 and 58 are traced from a first metal layer (e.g., Al layer 42 in FIG. 3). Conductor 58 is contacted through vias 62 to a common conductor 51 fabricated on a second metal layer (i.e., Ta/Au layer 46 in FIG. 3). Resistor 48 is fabricated from the first metal layer.

Common conductor 51 supplies electrical impulses to heating resistors 48. The second conductor layer used for conductor 51 eliminates the need for placing a large common conductor within shelf area 61. This is due to the fact that separate conductor trace 58 now individually couples each heating resistor 48 to common conductor 51. Conductors 54 and 58 are attached laterally to the ends of heater resistor 48 in a direction parallel with the ink feed slot 28. Therefore, the minimum attainable shelf length is not limited by the width of common conductor 51. The circuit configuration described above utilizes an existing conductive overcoat (e.g., Ta/Au layers 46 and 47 in FIG. 3) as the common conductor feed path. Therefore, no new process steps are required and only minor changes to the photolithographic masks are needed.

The circuit configuration shown in FIG. 4 is completely compatible with existing thin film resistor manufacturing processes. This compatibility increases printhead fabrication yields without requiring the implementation of process changes. In addition, using a second layer of conductor material for the common feed reduces the amount of substrate area used for routing resistor circuitry. For example, trace 58 is shorter allowing further miniaturization of the ink jet printhead, and at the same time, allows the width of the common conductor 51 to be increased.

Figure 5:
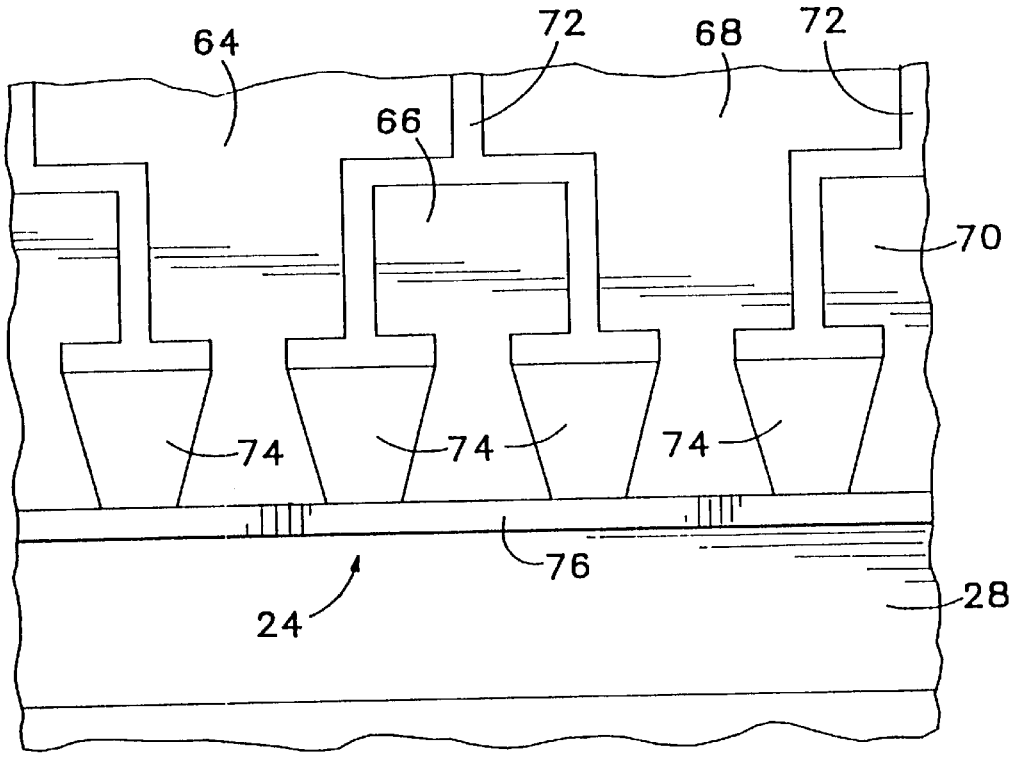
FIG. 5 is a top plan view of a resistor and ink feed channel according to a second embodiment of the invention.

FIG. 5 is a top plan view for a second embodiment of the invention. Conductor regions 64, 66, 68, and 70 are fabricated in a first conductor layer (e.g., Al layer 42 in FIG. 3). The conductor regions are separated by an insulative spacer 72. Multiple heater resistors 74 are coupled between adjacent conductor regions. Each resistor region has a trapezoid shape with the two opposite inclining sides contacting adjacent conductor regions, respectively, and the upper side isolated from either conductor region by the insulative spacer 72.

The lower side of each resistor region 74 abuts a shelf region 76, comprising the area of the thin film substrate 24 between the heater resistor 74 and ink feed slot 28. Conductor regions 64 and 68 serve as individual return conductors and conductor regions 66 and 70 serve as feed conductors. Regions 66 and 70 are contacted to a common conductor that is fabricated in a second conductor layer above conductors 64, 66, 68, and 70 through vias. For example, the common conductor would be fabricated in Ta/Au levels 46 and 47, as shown in FIG. 3. The heating resistors are spaced approximately 300 dpi apart (i.e., 85 $\mu$m pitch). Conductor regions 64 and 68 are as wide as possible (i.e., approximately 140 $\mu$m) to minimize resistance.

A current pulse is supplied to each heating resistor from a power supply (not shown) coupled to the common conductor residing in the second conductor layer. The pulse is received by the heater resistors 74 via conductor areas 66 and 70. Each conductor return (i.e., conductors 64 and 68) is coupled to two heating resistors to minimize the amount of substrate surface area used for separating adjacent conductors. This allows more flexibility in conductor layouts. By contacting conductors 66 and 70 to a common conductor fabricated on a second process layer, the common conductor no longer has to be located in the shelf area between each heating resistor and the ink feed slot. As explained above, this provides increased print speed by reducing the time required for ink to flow into the firing chambers after each firing.

It is important that heat is uniformly emitted from each heating resistor. Non-uniform heat dissipation (e.g., multiple hot zones) create inconsistent ink dispersion from the firing chamber, reducing print quality. The trapezoidal configuration used for the heating resistors shown in FIG. 5 decouples hot zones from the firing chambers, as explained further below in FIG. 6.

Figure 6:
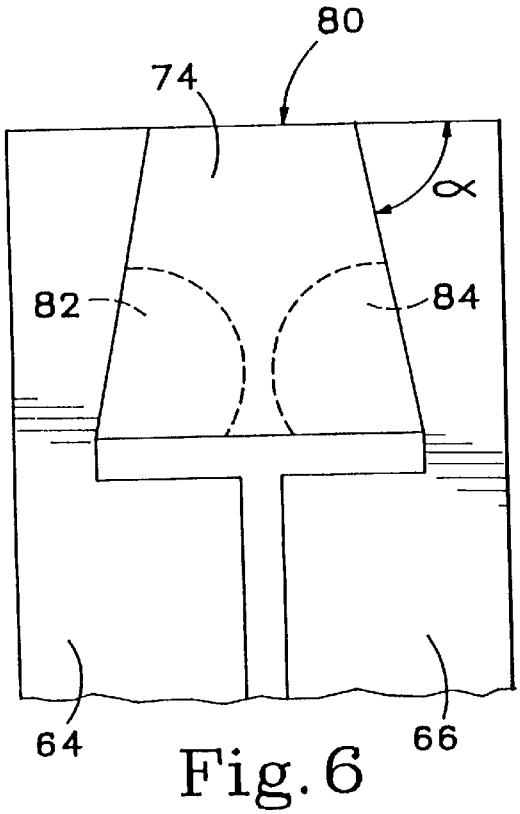
FIG. 6 is an enlarged top plan view of the trapezoidal resistor as shown in FIG. 5.
Figure 7:
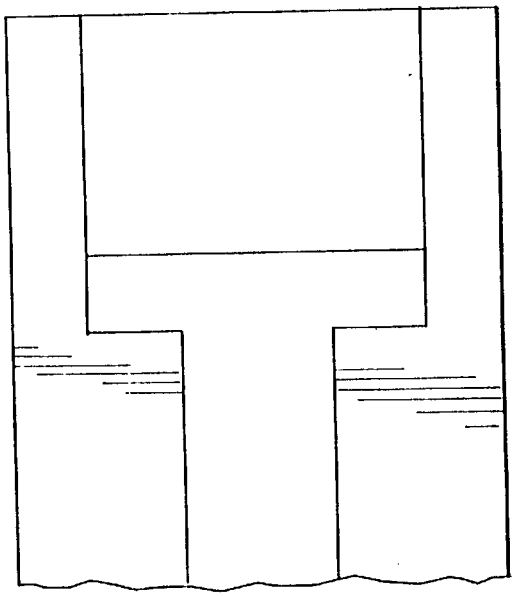
FIG. 7 is a top plan view of an alternative square heating resistor for use in the circuitry shown in FIG. 5.

FIG. 6 is an enlarged top view of a single heater resistor as shown in FIG. 5. The aspect angle $\alpha$ is altered according to the sheet resistance of the heating resistor 74 and the conductor areas 64 and 66. For example, when the conductors 64 and 66 have a low resistivity or the heater resistor resistivity is high, a can be increased to 90°. This provides a rectangular shaped heat resistor, as shown in FIG. 7 which maintains a generally uniform temperature across the resistor surface area. A typical conductor sheet resistance of 0.1 ohms per square ($\rho$=0.1 ohms/square) and a heater resistor resistance of approximately 28.0 ohms per square ($\rho$=28.0 ohms/square) provides consistent heat dissipation across resistor 74.

When the heater resistor-to-conductor resistance ratio is too small, multiple hot zones can occur in the heater resistor. For example, dashed areas 82 and 84 in FIG. 6 show hot zones that can occur on the heater resistor surface. When a current pulse is supplied to the heater resistor 74, it is desirable that the current flows evenly through the resistor surface area. If the resistor-to-conductor resistance ratio is not large enough, electrical current congregates in specific areas at the sides of the resistor. The heat dissipated, which is substantially proportional to the amount of current flow in the resistor, produces the hot zones shown in FIG. 6. These hot zones, which may extend into the conductor material, prevent the ink from being heated quickly and can obstruct the consistency of ink dispersed for the orifices above each firing chamber.

To eliminate these hot zones, the resistor aspect angle $\alpha$ is proportionally increased as shown in FIG. 6. This alters the corresponding aspect ratio (length-to-width) for the heater resistor, which alters the resistor's overall resistance. Thus, the trapezoidal configuration in FIG. 6 decouples the hot zones and provides a uniform heat gradient across the heater resistor 74. This allows variable sheet resistor values to be used in the fabrication process with only minimal changes in the resistor circuit masks.

Thus, the square heater resistor circuits used in previous ink jet printheads and their interdigitized conductor returns limit print speed and print quality. The circuits illustrated above in FIGS. 4–7 allow reduction in the shelf length which in turn increases print speed. In addition, coupling multiple heating resistors to the same conductor return and using a common conductor on a second process layer allow greater printhead die miniaturization. The result is increased print density and print swath while simultaneously reducing the cost of fabricating ink jet printheads by increasing fabrication yields.

The circuit configurations illustrated above increase the flexibility in attaching voltage polarities across the heater resistors. This allows alternative circuit configurations that further increase circuit miniaturization. The wide conductor regions allow greater control over the resistor-to-conductor resistance ratio. This provides more control over the heating characteristics of the heater resistors. Therefore, the trapezoidal heating resistor configuration shown in FIG. 5 can generate a uniform heating surface for higher density printheads.

Having described and illustrated the principles of the invention in a preferred embodiment thereof, it should be apparent that the invention can be modified in arrangement and detail without departing from such principles. I claim all modifications and variation coming within the spirit and scope of the following claims.

We claim:

1. An ink jet printhead comprising:

a subsequent having an upper surface and a lateral edge;

an ink feed formed in the substrate upper surface;

a plurality of firing chambers atop the substrate between the lateral edge and the ink feed;

each said firing chamber having a bottom wall comprising a resistance heater, a top wall having an ink discharge orifice, and a sidewall connecting the bottom and top walls;

a channel interconnecting each respective firing chamber and the ink feed, the bottom wall of said channel defining a shelf, the shelf having a length of about 30 micrometers or less;

first and second trapezoidal conductive trace, formed on a first conductive layer connected to opposed edges of each trapezoidal resistance heater, each first and second conductive trace extending toward the substrate lateral edge;

an insulative layer atop the first conductive layer, the insulative layer having vias defining a contact pad on the first conductive trace; and a shared conductor atop the insulative layer and spaced laterally apart from said shelf, the shared conductor connected through the vias to the contact pad of we first conductive trace.

2. An inkjet printhead according to claim 1 wherein a pair of adjacent resistance heaters are connected to the shared conductor.

3. An ink jet printhead according to claim 1 wherein the shared conductor is formed from tantalum gold.

4. An inkjet printhead according to claim 1 further comprising a power supply switchably coupled to each resistance heater.

5. An ink jet printhead according to claim 1 wherein the first and second trapezoidal conductive traces are positioned in inverted alignment to the trapezoidal resistance heater.

6. An inkjet printhead according to claim 1 wherein the aspect angle of the trapezoidal heaters is between 45 and 90 degrees.

7. An ink jet printhead according to claim 1 wherein the sheet resistance of the first conductive layer is between about 0.01 and 10 ohms per square centimeter.

8. An ink jet printhead according to claim 1 wherein the resistance heater-to-first conductive layer resistance ratio is greater than about 10:1.

9. An ink jet printhead according to claim 1 wherein the resistance heater-to-first conductive layer resistance ratio is greater than about 100:1.

10. An ink jet printed according to claim 1 wherein the ink jet printhead density is between 300 and 1200 dpi.

* * * * *

UNITED STATES PATENT AND TRADEMARK OFFICE

CERTIFICATE OF CORRECTION

PATENT NO : 5,808,640

DATED : September 15, 1998

INVENTOR(S) : Eldurkar V. Bhaskar, et al.

It is certified that error appears in the above-identified patent and that said Letters Patent is hereby corrected as shown below:

Column 6, Line 51 of the Patent, in claim 1
replace 2nd word "subsequent" with -- substrate --

Column 6, Line 56 of the Patent, in claim 1
add -- trapezoidal -- after "a" and before "resistence"

Column 6, Line 63, of the Patent, in claim 1
replace 6th word "trace" with -- traces --

Column 7, line 6 of the Patent, in claim 1
replace 10th word "we" with -- the --

Column 8, line 15 of the Patent, in claim 10
replace 4th word "printed" with -- printhead --

Signed and Sealed this

Twenty-second Day of December, 1998

*Attest:*

Bruce Lehman

BRUCE LEHMAN

*Attesting Officer*

*Commissioner of Patents and Trademarks*